US005219304A

United States Patent [19]

Lin

[11] Patent Number: 5,219,304

[45] Date of Patent: Jun. 15, 1993

[54] ELECTRICAL PLUG

[76] Inventor: Chen H. Lin, P.O. Box 82-144, Taipei, Taiwan

[21] Appl. No.: 980,234

[22] Filed: Nov. 23, 1992

[51] Int. Cl.[5] ..... H01R 13/58

[52] U.S. Cl. ..... 439/461; 439/696

[58] Field of Search ..... 439/106, 457, 461, 462, 439/695, 696

[56] References Cited

U.S. PATENT DOCUMENTS 3,571,781 3/1971 Gartland et al. ..... 439/465

FOREIGN PATENT DOCUMENTS 223455 1/1958 Australia ..... 439/461

3524384 1/1987 Fed. Rep. of Germany ..... 439/467

*Primary Examiner*—Eugene F. Desmond

*Attorney, Agent, or Firm*—Alfred Lei

[57] ABSTRACT

This invention relates to an electrical plug and in particular to one including a body portion, a plurality of blades extending through the body portion into an inner edge of a recess portion of the body so that their connecting ends are disposed in separated spaces, a cover having a shape adapted to engage with the recess portion of the body, and a threaded nut engaged with a threaded collet of the body portion for firmly keeping an electrical cord in a fixed position.

1 Claim, 4 Drawing Sheets

ELECTRICAL PLUG

BACKGROUND OF THE INVENTION

It has been found that the conventional electrical plug (see FIG. 5) mainly comprises an upper portion A20 and a lower portion A10 which are joined together by a screw extending through the threaded hole A201 of the upper portion A20 and the threaded hole A103 of the lower portion A10. The blades A30 are fixedly mounted in the lower portion A10 by screws A101. The electrical cord is kept in position by a press plate A102. However, such conventional electrical plug has the following drawbacks:

1. The housing composed of the upper portion and the lower portion is easily broken when subjected to pressure.

2. The blades cannot be firmly kept in a fixed position and may contact each other in case the housing is fused due to the improper use of the electrical cord.

3. The press plate cannot fix the electrical cord in position thereby making it liably disengaged with the blades.

FIG. 6 shows the manufacturing process of another conventional electrical plug. Although the electrical plug can obviate the drawbacks of the above-mentioned electrical plug, it cannot be repaired and should be discarded once the electrical cord is broken.

Therefore, it is an object of the present invention to provide an improved electrical plug which may obviate and mitigate the above-mentioned drawbacks.

SUMMARY OF THE INVENTION

This invention relates to an improved electrical plug.

It is the primary object of the present invention to provide an electrical plug of which the blades are fixedly and firmly embedded into the body portion.

It is another object of the present invention to provide an electrical plug which utilizes a collect member to keep the electrical cord in a fixed position.

It is still another object of the present invention to provide an electrical plug of which the copper connectors are disposed within three separated spaces thereby preventing the electrical cord from being short-circuited even when the spaces are fused by the high temperature led by the improper use of the electrical cord.

It is still another object of the present invention to provide an electrical plug which is safe in use.

It is a further object of the present invention to provide an electrical plug which is of great practical value.

Other objects and merits and a fuller understanding to the present invention will be obtained by those having ordinary skill in the art when the following detailed description of the preferred embodiment is read in conjunction with the accompanying drawings.

BRIEF DESCRIPTION OF THE PREFERRED EMBODIMENT

DETAILED DESCRIPTION OF THE PREFERRED EMBODIMENT

Figures 1A, 1B:
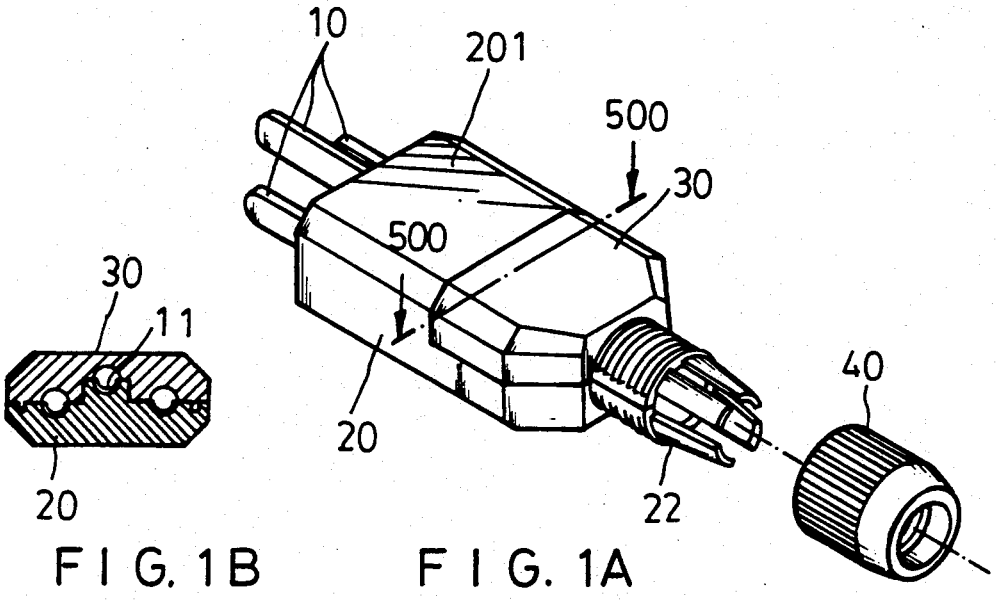
FIG. 1A is a perspective view of a plug according to the present invention.
FIG. 1B is a sectional view taken along line A—A of FIG. 3A.
Figure 2:
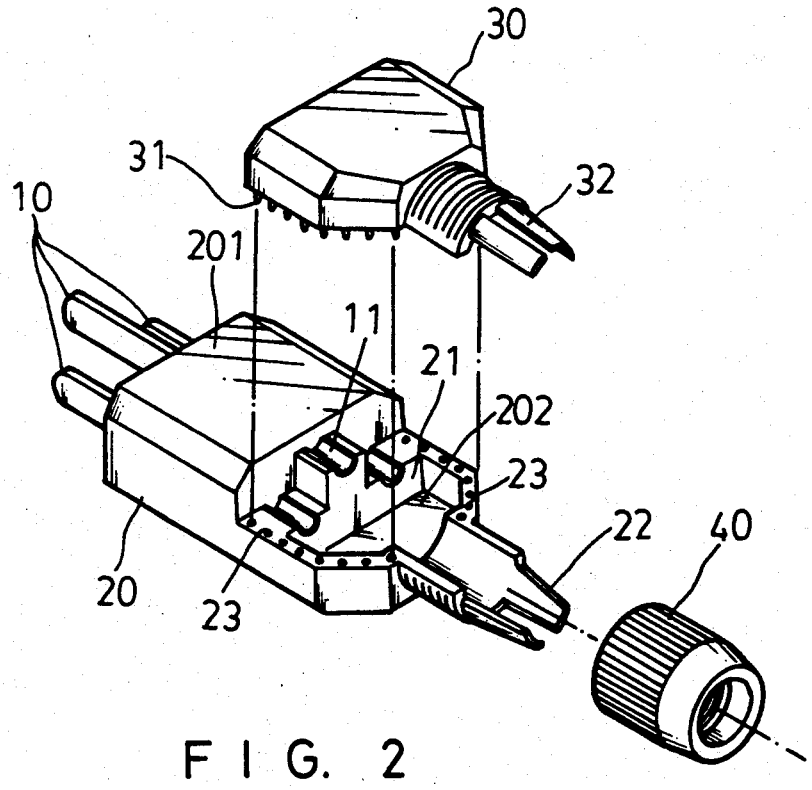
FIG. 2 is an exploded view of the plug according to the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 3:
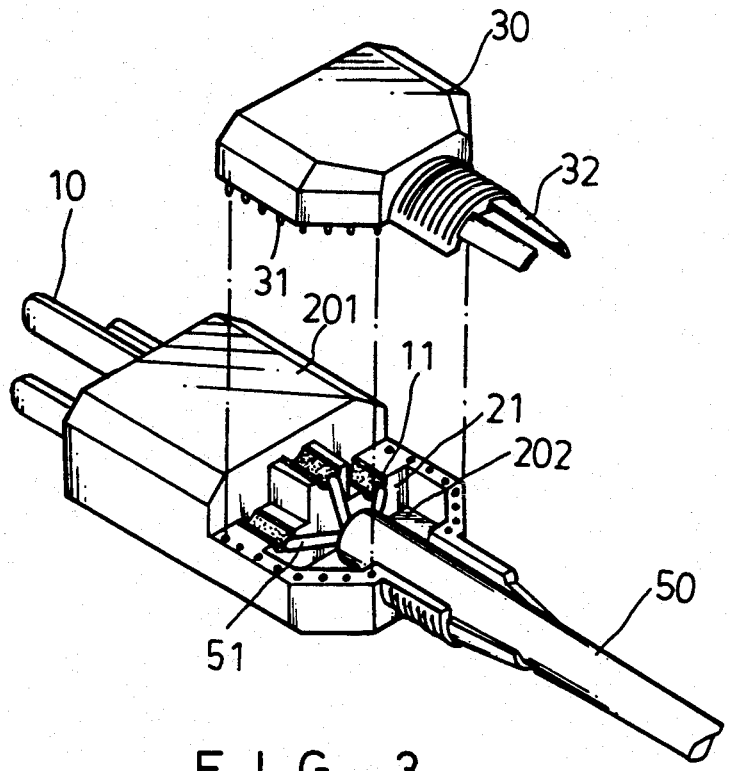
FIG. 3 shows the way to connect an electrical cord to the plug according to the present invention.
Figure 4:
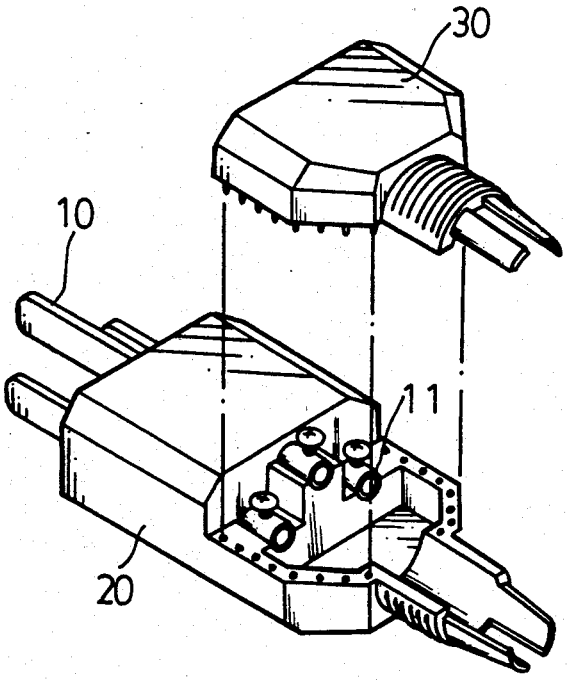
FIG. 4 shows another preferred embodiment of the present invention.
Figure 5:
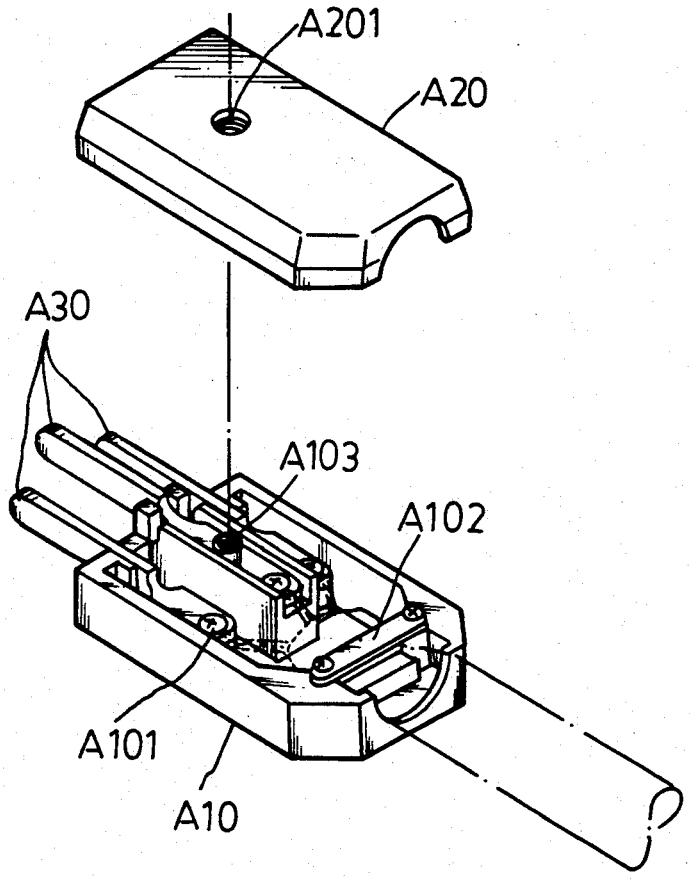
PRIOR ART FIG. 5
FIG. 5 is an exploded view of a prior art plug.
Figure 6:
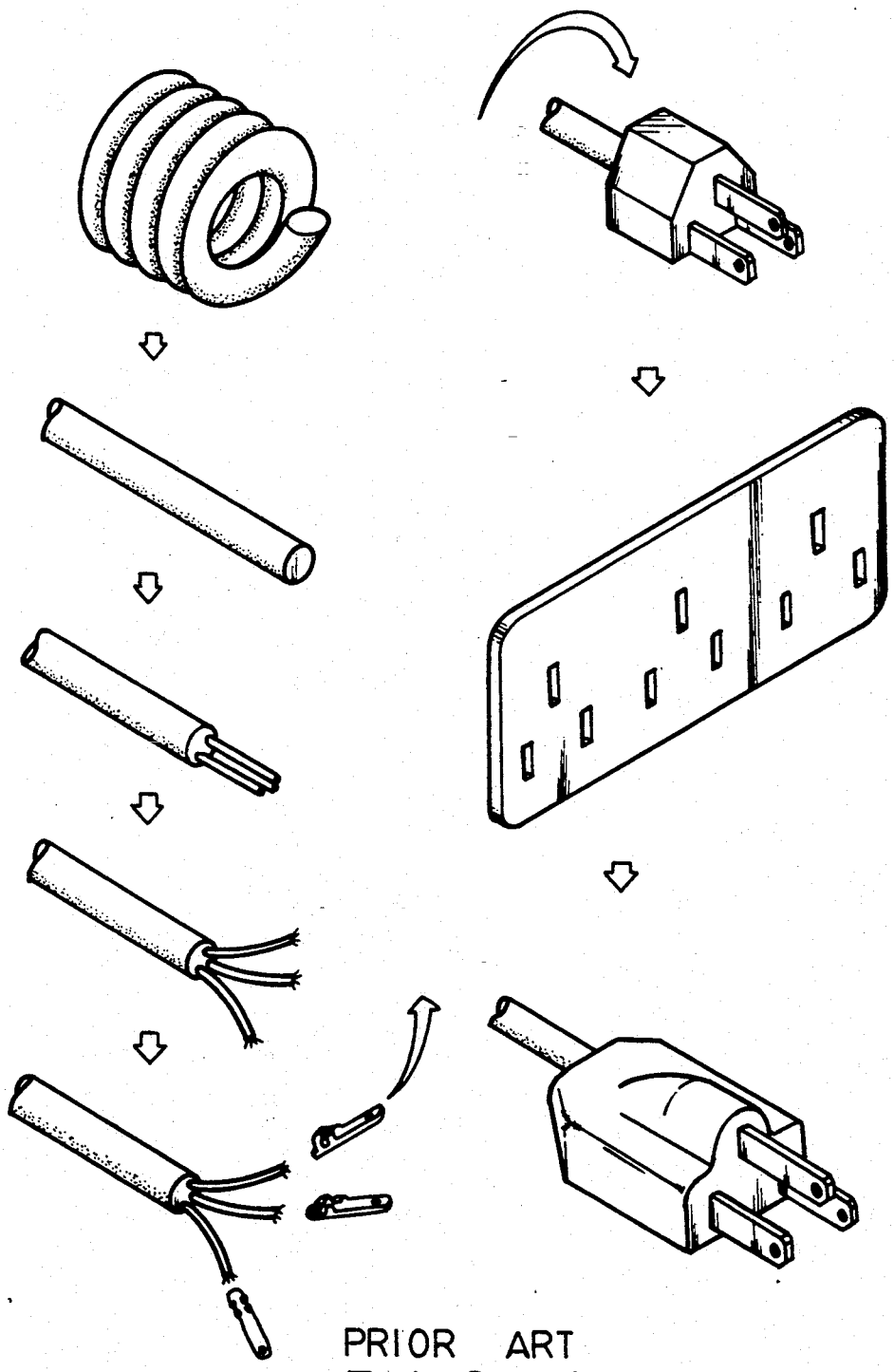
PRIOR ART FIG. 6
FIG. 6 shows the manufacturing process for another prior art plug.

With reference to the drawings and in particular to FIGS. 3A, 3B and 4, the plug according to the present invention mainly comprises three blades 10, a body 20, a cover 30, and a nut 40. The blades 10 are partially embedded into the body 20 and fixedly connected therewith when the body 20 is integrally formed by injection molding. Further, the body 20 is divided into a terminal portion 201 at the left end and a recess portion 202 at the right end. The recess portion 202 is provided with an inner edge 21 having a raised top and a shoulder at both sides of the raised top. A copper member 11 is mounted on each of the top and the shoulders of the inner edge 21 of the recess portion 202. Further, the recess portion 202 is provided with a plurality of holes 23 on its outer edge. In addition, the right end of the recess portion 202 has a threaded member 22.

The cover 30 is formed with an inner edge having a lowered central portion and a raised shoulder at both sides of the lowered central portion each of which has a groove. In addition, the cover 30 is provided with a plurality of pins 31 at its outer edge and a threaded member 22 at the right end. Hence, as the cover 30 is engaged with the recess portion 202 of the body 20, the inner edge, the pins 31 and the threaded member 22 will be adapted to the inner edge, the holes 23 and the threaded member of the recess portion 202 of the body 20 thereby forming three holes on the inner side and a threaded collet 32 at the right end. The threaded nut 40 is engageable with the threaded collet 32.

When in use, the cover 30 is opened first and then the electrical cord 50 is inserted into the plug through the threaded member 22 of the recess portion 202 of the body 20. Thereafter, the wires 51 of the electrical cord 50 are respectively welded or otherwise secured on the copper connectors 11. Then, the cover 30 is fitted on the body 20 and the threaded nut 40 is engaged with the threaded collet 32 thus keeping the electrical cord in a fixed position.

Another preferred embodiment of the present invention is shown in FIG. 4, wherein the copper member 11 is a tubular member with a set screw extending therein.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. An electrical plug comprising:

a body having a plurality of blades which are partially embedded into said body and have an end extending inwardly out of said body, said body having a recess portion provided with a plurality of holes on the outer edge and an inner edge having a raised top and a shoulder at both sides of said raised top, the upper surface of said raised top and said shoulder being adapted to receive the connecting end of said blades, said recess portion being formed with a first threaded member;

a cover formed with an inner edge having a lowered central portion and a raised shoulder at both sides of said lowered central portion each of which has a groove adapted to receive the connecting end of each said blade, said cover further having a plurality of pins adapted to engage with the holes on the outer edge of the recess part of said body and a second threaded member which will form a threaded collet when engaged with the first threaded member of said body; and a threaded nut engaged with said threaded collet for firmly keeping an electrical cord in a fixed position.

* * * * *